United States Patent [19]

Crossley et al.

[11] 3,966,568

[45] June 29, 1976

[54] ELECTROWINNING OF GALLIUM

[75] Inventors: Cecil L. Crossley, Rossland; Horst E. Hirsch, Trail, both of Canada; Shou C. Liang, Spokane, Wash.

[73] Assignee: Cominco Ltd., Trail, Canada

[22] Filed: Dec. 13, 1974

[21] Appl. No.: 532,546

[30] Foreign Application Priority Data

Oct. 21, 1974 Canada ..... 211805

[52] U.S. Cl. ..... 204/105 R

[51] Int. Cl.[2] ..... C25C 1/24

[58] Field of Search ..... 204/105 R, 99

[56] References Cited

UNITED STATES PATENTS

| | | | |
|---|---|---|---|
| 3,423,301 | 1/1969 | Stearns | 204/105 R |
| 3,677,918 | 7/1972 | Miyake et al. | 204/105 R |

*Primary Examiner*—R. L. Andrews

*Attorney, Agent, or Firm*—Arne I. Fors

[57] ABSTRACT

A process for producing gallium by electro-deposition from an acidic gallium chloride solution wherein electrolysis is conducted in the presence of metal ions of at least one metal from the group consisting of aluminium, zinc, calcium, magnesium, sodium and potassium dissolved in said solution.

11 Claims, No Drawings

ELECTROWINNING OF GALLIUM

BACKGROUND OF THE INVENTION

This invention relates to improvements in the electrowinning of gallium and, more particularly, to an improved process for producing gallium by electrodeposition from an acidic gallium chloride solution.

According to U.S. Pat. No. 3,423,301 which issued on Jan. 21, 1969, high purity gallium can be deposited electrolytically from a purified gallium trichloride solution in an acid medium by controlling and maintaining the mole ratio of the concentrations of the trivalent gallium cations and the acid anions close to its stoichiometric value during the electrolysis. This process, however, requires a purified gallium trichloride solution. Moreover, the electrolysis is conducted at high current densities of from 3,000 to 10,000 amperes per square metre ($A/m^2$) and a high current efficiency can only be maintained for short periods.

SUMMARY OF THE INVENTION

We have surprisingly found that gallium, of high purity if desired, can be advantageously produced with improved and continuous efficiency by electrolysis from a gallium trichloride solution in the presence of certain metal ions in the solution. More specifically, our invention comprises a process for the electrolytic recovery of gallium from an acidic, aqueous gallium trichloride solution which comprises conducting the electrolysis in the presence of metal ions of at least one metal from the group consisting of aluminum, zinc, calcium, magnesium, sodium and potassium.

It is, therefore, an important object of our invention to provide an improved process for producing gallium by the continuous electrolysis of an acidic solution of gallium trichloride.

It is another object of our invention to provide a continuous process for producing gallium by the electrolysis of a gallium trichloride solution in the presence of dissolved metal.

It is a further object of our invention to provide a continuous process for producing gallium by the electrolysis of a gallium solution in the presence of dissolved metal wherein the current efficiencies can be sustained at above at least 85%.

It is a further object of our invention to provide a process for the electrowinning of gallium from a gallium solution wherein the need for the removal of metals from the group consisting of aluminium, zinc, calcium, magnesium, sodium and potassium prior to electrolysis is obviated.

And a further object of our invention is to provide a process for the electrowinning of gallium from a gallium trichloride electrolyte at low electrode current densities.

These and other objects of the process of the invention and the manner in which they can be attained will become apparent from the following detailed description thereof.

DESCRIPTION OF THE PREFERRED EMBODIMENTS

A gallium trichloride solution, obtained according to known methods by treating gallium bearing raw materials, such as metals, compounds and concentrates thereof, is electrolyzed in electrolytic cells for the electrowinning of gallium in the following manner.

Each cell consists of a vessel containing a plurality of vertically disposed graphite plates which function as anodes and cathodes in alternate positions. The cathodes are enclosed in a fabric diaphragm which is supported in a frame to form cathode compartments which are designed to collect deposited gallium. The vessel is closed with a cover provided with openings to enable the discharge of gases evolved during electrolysis and to permit the insertion of a suction line into each cathode compartment for the removal of deposited gallium. Each cell is further equipped with an agitator for agitating the elctrolyte and a heater and thermistor to maintain the temperature of the electrolyte at desired values. Cooling means are normally not required.

The acidic gallium trichloride solution is continuously fed to the cells and a current is applied to the electrodes whereby metallic gallium deposits on the cathodes in the form of droplets which coalesce and fall to collect in the bottom of the cathode compartments. The molten gallium is removed periodically from the cathode compartments through the suction line in each compartment. In order to prevent the formation of undesirable compounds during electrolysis, hydrochloric acid must be added. Hydrochloric acid is added as a concentrated solution, e.g. 12 normal (N), in an amount of from about 0.1 to 1.0 milliliter per Ampere hour (ml/A.hr). The acid may be added separately or with the gallium trichloride solution. The pH of the electrolyte in the cells is maintained at values not exceeding about one. The concentration of gallium in the electrolyte is maintained in the range of from about 0.5 to 3.0 molar (M), the preferred concentration being from about 1.0 to 2.0 M.

During the electrolysis the electrolyte is continuously agitated and is maintained at a temperature in the range of from about 30° to 60°C., preferably at a temperature of about 50°C. The electrode current density is maintained in the range of from about 150 to 350 $A/m^2$, preferably in the range of from about 200 to 300 $A/m^2$, most preferably in the range of from about 200 to 230 $A/m^2$. The current efficiency is about 80%. The current density in the process of our invention is considerably below that in known processes disclosed in the art which generally use current densities ranging from 500 to as high as 20,000 $A/m^2$.

We have found that when the electrolysis is performed in the presence of certain dissolved metals, the current efficiencies of the electrolysis increase to values above 85% and as high as about 95%, which values can be sustained for the duration of the continuous electrolysis. Moreover, the presence of the dissolved metals during electrolysis does not interfere with the deposition of the gallium. Therefore, the process according to the invention not only enables the electrowinning of gallium in the presence of certain dissolved metals without interfering with the deposition of the gallium and the electrowinning of gallium from solutions without prior removal of the dissolved metals, but also enables the electrolysis to be performed at current efficiencies which can be sustained at said high values about 85% and up to about 95%.

The dissolved metal which may be present in the electrolyte is one or more metals of the group consisting of aluminium, zinc, calcium, magnesium, sodium and potassium. The maximum concentration of dissolved metal in the electrolyte is determined by solubilities in the system and can be as high as 3.0 M. The concentration of dissolved metal is usually in the range of from about 0.1 M to 2.0 M, and preferably about 0.5 M. It will be understood that the dissolved metals may be present in the electrolyte either singly or in combination.

The desired metal concentration of the above named metals in the electrolyte may be achieved by the addition of the metals in metallic form or in the form of oxides, carbonates or other suitable compounds thereof which form their chlorides with acid added to the solution, or, addition may be in the form of soluble salts such as, for example, chlorides or sulfates of the said metals. Alternatively, the dissolved metal or metals may be prepared in solution prior to addition to the gallium trichloride solution or to the electrolyte. When added to the solution or the electrolyte, the preferred metals are one or more metals from the group consisting of aluminium, calcium and magnesium, the most preferred metal being aluminium added in the form of aluminium chloride or sulfate.

The concentration of dissolved metal in the electrolyte is controlled at the molar values stated above. If necessary, a portion of the electrolyte may be withdrawn from the cells and this portion may be further treated to recover gallium or to remove dissolved metal. Further treatment of withdrawn electrolyte may comprise, for example, concentration and/or acidification of the solution to crystallize metal salt. After separation of the crystallized salt, the residual solution may be returned to the electrolysis.

The process according to the invention is suitable for the recovery of gallium from gallium bearing raw material and for the production of high purity gallium.

The invention will now be illustrated with reference to the following non-limitative examples.

EXAMPLE 1

This example illustrates that gallium trichloride solution can be electrolyzed at low current density and with a current efficiency of around 80%.

A solution of gallium trichloride containing excess hydrochloric acid was subjected to electrolysis in an electrolytic cell containing vertically disposed graphite electrodes, as described hereinabove, at a current density of 215 A/m$^2$. During the electrolysis the electrolyte was agitated and its temperature was controlled at 50°C. while the concentration of gallium in the electrolyte in the cell was maintained constant at 105 g/l by continuously feeding fresh solution. The electrolysis was performed continuously over a period of 7 days. The pH of the electrolyte in the cell was maintained at a value of approximately one. An amount of liquid gallium was removed daily from the cathode compartments in the cell. The gases evolved during electrolysis were removed from the cell and scrubbed with caustic solution prior to being vented. The current efficiency of the electrolysis was 82%.

EXAMPLE 2

This example illustrates that gallium can be electrowon from a gallium trichloride electrolyte containing dissolved metal, as discussed hereinabove, and that electrowon gallium can be produced with a current efficiency of above 85%.

Using a cell with vertical graphite electrodes, as previously described, a series of tests was made wherein a solution of gallium trichloride was subjected to electrolysis with the addition of various amounts of different metals in the form of chlorides. The test parameters and results are given in Table I. The results of test No. 1, wherein no dissolved metal was present in the gallium trichloride electrolyte, show that the current efficiency was only 78%. The results of tests Nos. 2 through 8, wherein respectively, aluminium, calcium, sodium, magnesium, potassium and zinc were added in the form of chlorides, show improved current efficiencies, ranging from 83 to 90%, and improved gallium yields. The gallium deposited in each of the tests was recovered separately and analyzed. The analysis results showed that the gallium contained 0.1 part per million, or less, of aluminium, calcium and magnesium. The contents of sodium, potassium and zinc were below the levels of detection by emission spectrographic analysis.

TABLE I

| | TEST NUMBER | | | |
|---|---|---|---|---|
| | 1 | 2 | 3 | 4 |
| Duration — hours | 45 | 46 | 42 | 47 |
| Electrolyte Temperature — °C. | 50 | 50 | 50 | 50 |
| pH of Electrolyte | 1 | 1 | 1 | 1 |
| Current Density — A/m$^2$ | 215 | 215 | 215 | 215 |
| Initial Electrolyte | | | | |
| Volume — l | 9.0 | 9.0 | 9.4 | 9.0 |
| $Ga^{3+}$ content — g/l | 110 | 119 | 109 | 109 |
| Metal salt content — g/l | None | 166 $AlCl_3$ | 167 $CaCl_2$ | 13 NaCl |
| Electrolyte added during Electrolysis | | | | |
| $Ga^{3+}$ content (as$GaCl_3$)— g | 670 | 585 | 585 | 620 |
| 12 N HCl — l | 0.54 | 0.47 | 0.40 | 0.16 |
| Final Electrolyte | | | | |
| Volume — l | 8.0 | 8.4 | 8.5 | 8.9 |
| $Ga^{3+}$ content — g/l | 120 | 111 | 113 | 102 |
| Gallium Deposited — g | 600 | 693 | 617 | 703 |
| Current Efficiency — % | 78 | 89 | 87 | 86 |

| | TEST NUMBER | | | |
|---|---|---|---|---|
| | 5 | 6 | 7 | 8 |
| Duration — hours | 101 | 46.5 | 72 | 47 |
| Electrolyte Temperature — °C. | 50 | 50 | 50 | 50 |
| pH of Electrolyte | 1 | 1 | 1 | 1 |
| Current Density — A/m$^2$ | 215 | 215 | 215 | 215 |
| Initial Electrolyte | | | | |
| Volume — l | 9.0 | 9.0 | 8.5 | 9.1 |
| $Ga^{3+}$ content — g/l | 81 | 109 | 108 | 90 |
| Metal salt content — g/l | 105 NaCl | 48 $MgCl_2$ | 150 KCl | 68 $ZnCl_2$ |
| Electrolyte added during Electrolysis | | | | |

TABLE I-continued

| | | | | |
|---|---|---|---|---|
| $Ga^{3+}$ content (as$GaCl_3$) — g | 1503 | 662 | 1002 | 654 |
| 12 N HCl — l | 0.76 | 0.4 | 0.5 | 0.4 |
| Final Electrolyte | | | | |
| Volume — l | 8.9 | 8.5 | 8.2 | 8.6 |
| $Ga^{3+}$ content — g/l | 78 | 113 | 94 | 98 |
| Gallium Deposited — g | 1522 | 691 | 1124 | 677 |
| Current Efficiency — % | 87 | 85 | 90 | 83 |

EXAMPLE 3

This example illustrates that gallium can be electrowon from a gallium trichloride electrolyte containing dissolved metal in the form of sulfate.

Using a cell with vertical graphite electrodes, as previously described, a series of tests was made wherein electrolyte containing varying amounts of gallium as $GaCl_3$ and an amount of aluminium sulfate ($Al_2(SO_4)_3$) was subjected to electrolysis. The test parameters and results are given in Table II.

The results show that gallium can be won from gallium trichloride electrolyte containing aluminium sulfate and at a current efficiency higher than from electrolyte free of aluminium sulfate. (Compare with Example I and test number 1 in Table I.) The results also show that the current efficiency increases with increasing concentration of gallium in the electrolyte.

TABLE II

| | TEST NUMBER | | |
|---|---|---|---|
| | 1 | 2 | 3 |
| Duration — hours | 47.5 | 46 | 47 |
| Electrolyte temperature — °C | 50 | 50 | 50 |
| pH of Electrolyte | 1 | 1 | 1 |
| Current Density — A/m² | 215 | 215 | 215 |
| Initial Electrolyte | | | |
| Volume — l | 8.8 | 9.1 | 9.0 |
| $Ga^{3+}$ content — g/l | 57 | 71 | 88 |
| $Al_2(SO_4)_3$ content — g/l | 171 | 171 | 171 |
| Electrolyte added during Electrolysis | | | |
| $Ga^{3+}$ content — g | 629 | 668 | 641 |
| 12 N HCl — l | 0.4 | 0.4 | 0.4 |
| Final Electrolyte | | | |
| Volume — l | 8.4 | 8.8 | 8.7 |
| $Ga^{3+}$ content — g/l | 48 | 63 | 73 |
| Gallium Deposited — g | 709 | 730 | 782 |
| Current Efficiency — % | 86 | 91 | 96 |

It will be understood, of course, that modifications can be made in the preferred embodiment of the present invention as described hereinabove without departing from the scope and purview of the appended claims.

What we claim as new and desire to protect by Letters Patent of the United States is:

1. A process for the electrolytic recovery of gallium from an acidic, aqueous gallium trichloride solution which comprises the steps of feeding said solution containing gallium in a concentration of up to about 3 molar to electrolytic cells, electrolyzing said solution at an electrode current density in the range of about 150 to 350 A/m² and conducting said electrolysis in presence of metal ions of at least one metal chosen from the group consisting of aluminum, zinc, calcium, magnesium, sodium and potassium dissolved in said solution, said metal ions being present in a concentration of up to about 3 molar.

2. A continuous process for the electrolytic recovery of gallium from an acidic, aqueous gallium trichloride solution which comprises the steps of establishing in said solution a concentration of up to about 3.0 molar of at least one metal selected from the group consisting of aluminium, zinc, calcium, magnesium, sodium and potassium, continuously feeding the solution to electrolytic cells, continuously electrolyzing said solution containing dissolved metal at an electrode current density in the range of from about 200 to 300 A/m² and at a temperature in the range of from about 30° to 60°C., whereby the current efficiency is sustained at values of at least about 85%, and recovering gallium metal.

3. A process as claimed in claim 2 wherein the dissolved metal is present in a concentration of metal in the range of from about 0.1 to 2.0 molar.

4. A process as claimed in claim 2 wherein the dissolved metal is present in a concentration of metal of about 0.5 molar.

5. A process as claimed in claim 2 wherein the electrolysis is conducted in electrolytic cells containing vertical cathodes, positioned in diaphragm enclosed compartments, and vertical anodes.

6. A process as claimed in claim 2 wherein at least one of said metals is added to said gallium trichloride solution in a form which forms a chloride of said metal.

7. A process as claimed in claim 2 wherein at least one of said metals is added to said gallium trichloride solution in the form of a chloride or a sulfate.

8. A process as claimed in claim 2 wherein the gallium trichloride solution contains gallium in a concentration in the range of from about 0.5 to 3.0 molar.

9. A process as claimed in claim 3 wherein said metal is from the group consisting of aluminium, calcium and magnesium.

10. A process for the electrolytic recovery of gallium from an acidic, aqueous gallium trichloride solution which comprises the steps of preparing an acidic, aqueous gallium trichloride solution, containing a chloride of at least one metal selected from the group consisting of aluminium, zinc, calcium, magnesium, sodium and potassium, continuously feeding said solution to electrolytic cells containing vertical graphite cathodes positioned in diaphragm enclosed compartments and vertical graphite anodes, electrolyzing said solution at an electrode current density in the range of from about 200 to 230 A/m², maintaining the temperature of the electrolyte at about 50°C., maintaining the pH of the electrolyte during electrolysis at about one, maintaining the concentration of gallium ions during electrolysis in the range of from about 0.5 to 3.0 molar, maintaining the concentration of said metal in the range of from about 0.1 to 2.0 molar, and recovering electro-deposited gallium from said compartments.

11. A process as claimed in claim 10, wherein high purity gallium is recovered.

* * * * *